US007661400B2

(12) United States Patent
Seitz et al.

(10) Patent No.: US 7,661,400 B2
(45) **Date of Patent: *Feb. 16, 2010**

(54) SWITCHABLE CAM FOLLOWER

(75) Inventors: Joachim Seitz, Schlusselfeld (DE); Bodo Rorig, Weisendorf (DE)

(73) Assignee: Schaeffler KG, Herzogenaurach (DE)

( * ) Notice: Subject to any disclaimer, the term of this patent is extended or adjusted under 35 U.S.C. 154(b) by 202 days.

This patent is subject to a terminal disclaimer.

(21) Appl. No.: 11/577,632

(22) PCT Filed: Sep. 21, 2005

(86) PCT No.: PCT/EP2005/010180

§ 371 (c)(1),
(2), (4) Date: May 14, 2007

(87) PCT Pub. No.: WO2006/045382

PCT Pub. Date: May 4, 2006

(65) Prior Publication Data

US 2007/0283915 A1 Dec. 13, 2007

(30) Foreign Application Priority Data

Oct. 22, 2004 (DE) ..... 10 2004 051 422

(51) Int. Cl.
*F01L 1/18* (2006.01)

(52) U.S. Cl. ..... 123/90.39; 123/90.44; 74/569

(58) Field of Classification Search ..... 123/90.16, 123/90.2, 90.39, 90.44, 90.45, 90.46; 74/559, 74/567, 569

See application file for complete search history.

(56) References Cited

U.S. PATENT DOCUMENTS 5,544,626 A 8/1996 Diggs et al.
7,174,869 B2 * 2/2007 Proschko et al. ..... 123/90.39
7,328,675 B2 * 2/2008 Seitz et al. ..... 123/90.39

(Continued)

FOREIGN PATENT DOCUMENTS

DE 4212844 10/1993

(Continued)

OTHER PUBLICATIONS

Herausgeber Werner Kulke, Fertigungstechnik Metall, Veb Verlag Technik Berlin, 1973, pp. 88 and 89.

*Primary Examiner*—Ching Chang
(74) *Attorney, Agent, or Firm*—Volpe and Koenig, P.C.

(57) ABSTRACT

A switchable finger lever (1) of a valve train of an internal combustion engine is provided, including an outer lever (3) and an inner lever (4) that extends between the arms thereof. One end of the outer lever (3) is provided with a contact area (6) for a head of a resting element on the bottom side (5) thereof. A smooth-faced longitudinal recess (7) for a coupling means (8) extends above the contact area (6). Some sections of the coupling means (8) can be engaged with the driving area (9) located on a face (10) of the inner lever (4) when the levers (3, 4) are coupled. The coupling means (8) is provided as a circular cylinder which is freely rotatable in the longitudinal recess (7) that is provided as a bore. The driving area (9) is provided on the inner lever (4) so as to be complementary to the outer envelope (14) of the coupling means (8). Durability in the coupling zone is improved as a result of the fact that the coupling means (8) is freely rotatable.

9 Claims, 1 Drawing Sheet

U.S. PATENT DOCUMENTS

| | | | | |
|---|---|---|---|---|
| 7,377,247 | B2 * | 5/2008 | Seitz | 123/90.39 |
| 2003/0111031 | A1 | 6/2003 | Hendricksma et al. | |
| 2004/0103869 | A1 | 6/2004 | Harris | |

FOREIGN PATENT DOCUMENTS

| | | |
|---|---|---|
| DE | 4316860 | 5/1994 |
| DE | 19535498 | 3/1997 |
| DE | 10310226 | 9/2004 |
| DE | 10311358 | 9/2004 |
| DE | 102004007766 | 9/2004 |
| EP | 1544423 | 12/2004 |
| GB | 797569 | 7/1958 |
| WO | 2004083608 | 9/2004 |
| WO | 2004094791 | 11/2004 |

* cited by examiner

SWITCHABLE CAM FOLLOWER

BACKGROUND

The invention relates to a switchable finger lever of a valve train of an internal combustion engine, comprising an outer lever and an inner lever extending between the arms of this outer lever. Both levers can pivot relative to each other and one of the levers has on its bottom side a contact area for a head of a support element. In the region of this contact area there runs a longitudinal recess for a coupling means, which can be brought into engagement in some sections with a driving area on an end side of the other lever when the levers are coupled. At least one contact area for a large lift cam is applied to an upper side of the finger lever.

Such a finger levers emerge from U.S. Pat. No. 5,544,626 which is considered as a class-forming patent. This is described as a disconnecting lever, wherein when coupled, its coupling means viewed in the longitudinal direction of the lever can be displaced inwards under a driving area of a pivoting inner lever. The coupling means extends above a contact area for a support element in the outer lever. It is to be recognized that in the coupling area, flat engagement structures are provided. In addition, the coupling means are provided with a separate anti-rotation device.

Several disadvantages are inherent in the previously mentioned construction. The flattened section on the coupling means as well as the correspondingly flat driving area on the bottom side of the inner lever require unnecessary machining expense and thus increase the costs for mass production. In addition, it is clear that the separate anti-rotation device also has an unfavorable effect on the total costs of the previously mentioned finger lever. However, a particular disadvantage in the finger lever just cited is that due to the coupling elements with a fixed orientation, coupling is always realized at the same contact position. Thus, in the operation of the finger lever it is to be taken into account that grooves are formed in this fixed contact position little by little and it possibly also leads to undesired deformation or formation of indentations in this region.

SUMMARY

The object of the invention is to create a switchable finger lever of the type named above, in which the cited disadvantages are corrected.

According to the invention, this objective is met in that the coupling means are constructed as a circular or hollow cylinder, which can rotate freely in its longitudinal recess made as a bore, wherein the driving area on the other lever is shown as complementary to the outer shell of the coupling means on its bottom side at least in the engagement area.

Thus, a switchable finger lever is provided with longitudinal locking, in which the disadvantages cited above are effectively corrected. In particular, through the freely rotating coupling means, wherein the rotational movement can occur during the operation of the finger lever randomly or caused by the force of a compression spring (see below), it is provided that the finger lever is provided in the coupling area with higher durability. Indentations in the contact area or plastic deformation and/or the formation of grooves are no longer to be noted.

By eliminating the flattened sections noted in the state of the art, the coupling means can be provided with a circular or hollow cylinder and thus can be processed in an economical center-less grinding method for mass production.

The driving area on the other lever, which engages the coupling means in the coupling case, can be produced, for example, like a circular segment. Someone skilled in the art will ensure in common design methods that, on one hand, good lubrication is provided in the contact area and, on the other hand, a necessary coupling play is given. Due to the radial contours in the coupling area, reduced contact pressures relative to the state of the art are to be taken into affect.

Alternatively, the driving area on the other lever can also be produced as a bore. In the case of a construction of the finger lever as a disconnecting lever, arms of the outer lever can wrap around the inner lever. When coupled, the disk-like coupling means are displaced in its preferably perforated, non-stepped longitudinal recess axially inwards at the bottom or in the driving area of the corresponding end side of the pivoting inner lever.

Another subordinate claim relates to a useful refinement of the finger lever according to the invention. Accordingly, this should be displaced in the coupling direction by means of a hydraulic medium and in the decoupling direction by means of the force of at least one helical compression spring. The coupling means are preferably guided by means of a very short branch bore directly from the contact area constructed, e.g., as a dome, behind an outer end side of the coupling means.

For the purpose of simple return displacement of the coupling means for falling hydraulic medium pressure, for example, for a complete deactivation of the finger lever, a thin-walled body, which ends axially outside in an annular collar, projects from the outer end face of the coupling means. The helical compression spring is supported with one end against the annular collar and acts with the other end against a base of a stop bushing, which is fixed, in turn, on the outside in the longitudinal recess.

Optionally, displacement of the coupling means in both directions by means of hydraulic medium is also conceivable or other spring means than helical compression springs can also be used. Also, instead of the hydraulic medium, the coupling means can be displaced in at least one direction by means of magnets, electromagnets, and other external or internal control means.

Simple attachment measures of the thin-walled body mentioned above is the subject matter of another subordinate claim. Accordingly, this should be constructed as a thin-walled sheet-metal body, also for weight reasons, which is roller-burnished, for example, onto a truncated cone-like projection of the coupling means. Optionally, in this area a clip, snap, adhesive, solder, or weld connection or the like can also be provided. Instead of the small tube, a body made from solid material can also be applied.

It is advantageous to construct a base of the driving area of the inner lever (for the case, for which the longitudinal recess extends with the coupling means in the outer lever) as a stop for an inner end face of the coupling means. Thus, simple path limiting for the coupling means is provided in its coupling direction. Alternatively, it is provided to create a stop for the coupling means in its coupling direction by means of a stop of the previously mentioned annular collar on an outer end of the stop bushing.

Preferably, the finger lever should be constructed as a disconnecting lever. However, it is also conceivable and provided to represent these as reversing levers. The contact surface on the inner lever can be constructed selectively as a roller or as a sliding surface. If a roller is used, an especially low-friction cam contact is generated.

BRIEF DESCRIPTION OF THE DRAWINGS

The invention is preferably explained in more detail with reference to the drawings. Shown are.

Figure 1:
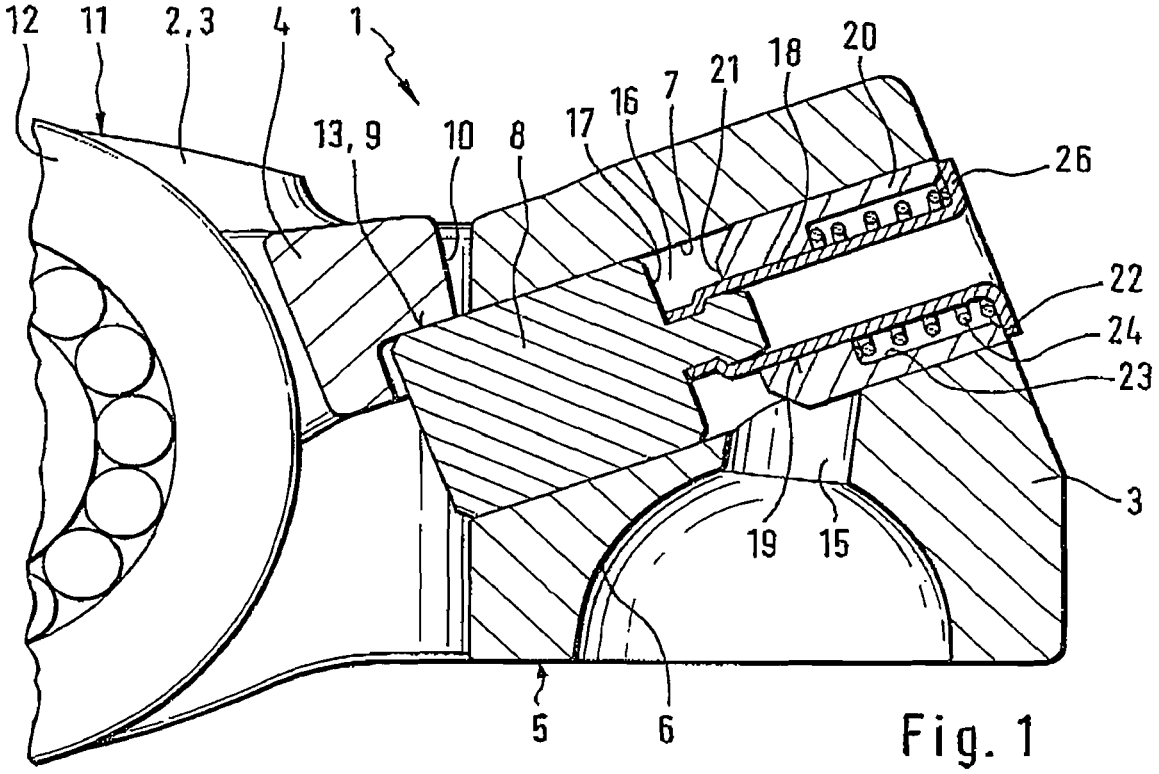
FIGS. 1 and 2, the finger lever according to the invention in partial longitudinal cross-sectional views with different stops for its coupling means.

The figures disclose a switchable finger lever 1, as described by its basic design and the operating mode in U.S. Pat. No. 5,544,626 cited above. The finger lever 1 is comprised of an outer lever 3 with two fork-like arms 2. These enclose an inner lever 4 that can pivot relative to the outer lever 3. Both levers 3, 4 are supported on the not shown left side of the image, for example, on a common pivot axis.

The outer lever 3 has on its bottom side 5 a contact area 6 constructed here as a dome for a head of a support element not shown in the drawing. By means of this head, as explained in more detail below, hydraulic medium can be guided via a short branch bore 15 into an annular space 16 behind an outer end face 17 of a piston-like coupling means 8.

A perforated, smooth-faced longitudinal recess 7 runs in the outer lever 3 above the contact area 6. The coupling means 8 are positioned in this recess so that they can move axially. The coupling means has on its outer end face 17 a truncated cone-like projection 27. With this projection 27, a thin-walled body 18 is connected rigidly, which is here constructed as a small tube. This body 18 is in turn guided through an opening 19 of a stop bushing 20 and can move longitudinally relative to this opening 19. The stop bushing 20 is fixed axially outside in the longitudinal recess 7. It has a bore 23 starting from its outer end 22. On one end, a helical compression spring 24 extends to a base 25 of the bore 23. On the other end, this acts against an annular collar 26 of the body 18.

DETAILED DESCRIPTION OF THE PREFERRED EMBODIMENTS

According to FIG. 1, which discloses the coupling state of the coupling means 8, the annular collar 26 contacts the outer end 22 of the stop bushing 20. Thus, path limiting for the coupling means 8 is given in its coupling direction.

As is to be further taken from the figures, the coupling means 8 are produced as a circular cylinder. Thus, this can be processed, for example, in an economical center-less grinding method on its outer shell 14.

In the area of an end side 10 of the inner lever 4, which pivots when decoupled, a driving area 9 constructed as a circular segment is constructed on a bottom side 13. For sufficient hydraulic medium pressure contacting the annular space 16, the coupling means 8 are thus pushed in a cam base-circle phase in some sections out of its longitudinal recess 7 under the driving area 9, which is constructed complementary to the outer shell 14 of the coupling means 8.

Due to the free rotation of the coupling means 8, over many coupling cycles a different area of its outer shell 14 always comes into contact with the corresponding section of the driving area 9. Thus, the formation of grooves in this contact area with the disadvantages described above is avoided. The durability of the entire device is significantly improved in this area. Relative to the flat coupling area provided in the previously described state of the art, there is better lubrication with reduced contact pressure.

Figure 2:
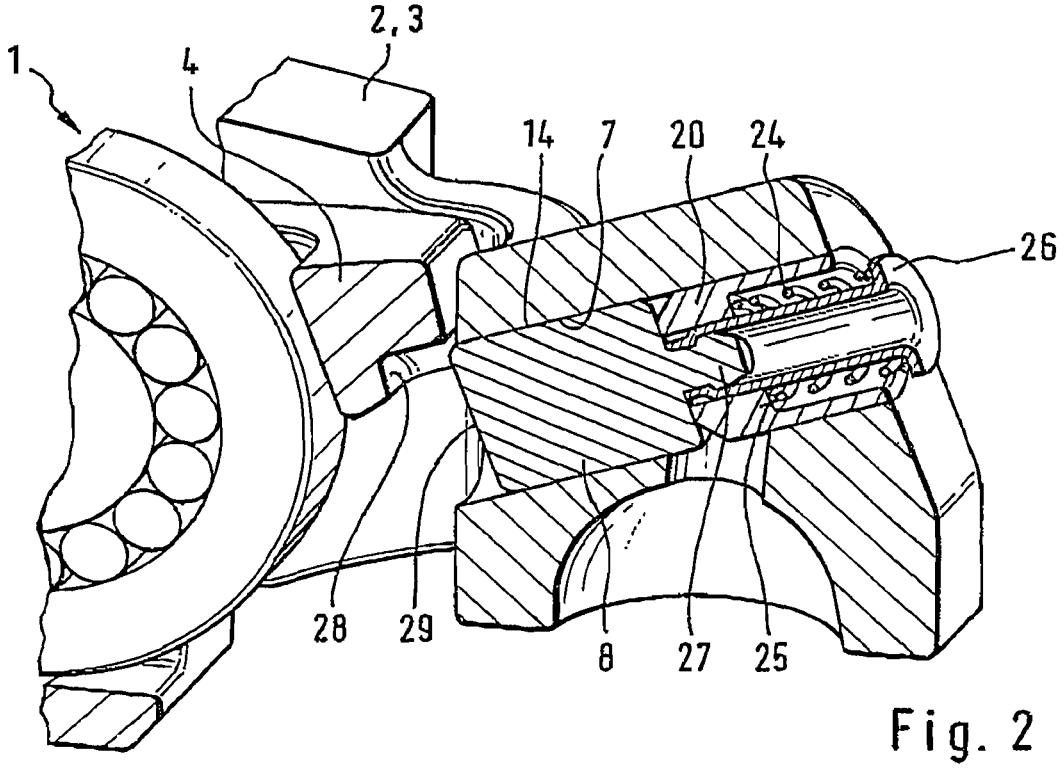

The difference in FIG. 1 relative to the solution illustrated in FIG. 2 is provided in that here path limiting for the coupling means 8 is created in the coupling direction via a base 28 of the driving area 9 constructed as a circular segment on the inner lever 4. When coupled, an inner end face 29 of the coupling means 8 contacts this base 28.

LIST OF REFERENCE NUMBERS

1) Finger lever
2) Arm
3) Outer lever
4) Inner lever
5) Bottom side
6) Contact area
7) Longitudinal recess
8) Coupling means
9) Driving area
10) End side
11) Upper side
12) Contact area
13) Bottom side
14) Outer shell
15) Branch bore
16) Annular space
17) Outer end face
18) Body
19) Opening
20) Stop bushing
21) Inner end
22) Outer end
23) Bore
24) Helical compression spring
25) Base
26) Annular collar
027) Projection
28) Base
29) Inner end face

The invention claimed is:

1. A switchable finger lever of a valve train of an internal combustion engine, comprising an outer lever and an inner lever extending between arms of the outer lever, wherein both of the levers can pivot relative to each other and one of the inner and outer levers has on one end on a bottom side thereof a contact area for a head of a support element, wherein in a region of the contact area there extends a longitudinal recess for a coupling element, which, when the levers are coupled, can be brought into engagement in some sections with a driving area on an end side of the other lever, and wherein on an upper side of the finger at least one contact area is provided for a large lift cam, the coupling element comprises a circular or hollow cylinder, which can rotate freely in the longitudinal recess produced as a bore, the driving area on the other lever is complementary to an outer shell of the coupling element at least in an engagement area on a bottom side thereof, and the longitudinal recess for the coupling element extends above the contact area for the head of the support element which is constructed as a dome or as a cylindrical depression in the outer lever, and when coupled the coupling element viewed in a longitudinal direction of the outer lever is displaced inwards under the driving area which is constructed as a circular segment in an end side of the inner lever.

2. The finger lever according to claim 1, wherein the outer shell of the coupling element is produced in a center-less grinding method.

3. The finger lever according to claim 1, wherein a base of the driving area of the inner lever constructed as a circular segment or bore is constructed as a stop communicating with an inner end face of the coupling element and parallel to the inner end face for the element in the coupling direction.

4. The finger lever according to claim 1, wherein the finger lever comprises a disconnecting lever, and the inner lever has the at least one contact area for the large lift cam constructed as a roller or sliding area.

5. The finger lever according to claim 1, wherein the longitudinal recess is constructed as a continuous, non-stepped bore.

6. A switchable finger lever of a valve train of an internal combustion engine, comprising an outer lever and an inner lever extending between arms of the outer lever, wherein both of the levers can pivot relative to each other and one of the levers has on one end on a bottom side thereof a contact area for a head of a support element, wherein in a region of the contact area there extends a longitudinal recess for a coupling element, which, when the levers are coupled, can be brought into engagement in some sections with a driving area on an end side of the other lever, and wherein on an upper side of the finger at least one contact area is provided for a large lift cam, the coupling element comprises a circular or hollow cylinder, which can rotate freely in the longitudinal recess produced as a bore, the driving area on the other lever is complementary to an outer shell of the coupling element at least in an engagement area on a bottom side thereof, and a branch bore leads from the contact area for the head of the support element directly into an annular space behind an outer end face of the coupling element, hydraulic medium can be introduced by the branch bore for displacing the coupling element in the coupling direction out of the support element, and a thin-walled body extends centrally away from the outer end face of the coupling element, with the body being guided in a sealed manner through an opening of a stationary stop bushing axially outside in the longitudinal recess, having an inner end that limits the annular space axially outwards, wherein the stop bushing, starting from an outer end thereof, has a bore with at least one helical compression spring, the helical compression spring acts on one end against a base of the bore and on an other end against a radially outwardly directed annular collar of the thin-walled body, such that the coupling element can be displaced in a decoupling direction.

7. The finger lever according to claim 6, wherein the thin-walled body comprises a sheet-metal small tube, which is combined with a truncated cone-like projection on the outer end face of the coupling element and is connected to the truncated cone-like projection.

8. The finger lever according to claim 6, wherein the annular collar of the thin-walled body projects radially past the bore of the stop bushing, such that when the annular collar contacts the outer end of the stop bushing a stop is created for the coupling element in the coupling direction.

9. The finger lever according to claim 6, wherein the longitudinal recess for the coupling element extends above the contact area for the head of the support element which is constructed as a dome or as a cylindrical depression in the outer lever, and when coupled the coupling element viewed in a longitudinal direction of the outer lever is displaced inwards under the driving area which is constructed as a circular segment in an end side of the inner lever.

* * * * *